US009856595B2

(12) United States Patent
Leonard et al.

(10) Patent No.: US 9,856,595 B2
(45) Date of Patent: Jan. 2, 2018

(54) WASHING MACHINE APPLIANCES AND METHODS FOR OPERATING THE SAME

(71) Applicant: General Electric Company, Schenectady, NY (US)

(72) Inventors: Ryan Ellis Leonard, Louisville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 798 days.

(21) Appl. No.: 14/252,887

(22) Filed: Apr. 15, 2014

(65) Prior Publication Data

US 2015/0292138 A1 Oct. 15, 2015

(51) Int. Cl.
*D06F 39/04* (2006.01)
*D06F 39/08* (2006.01)

(52) U.S. Cl.
CPC ..... *D06F 39/088* (2013.01); *D06F 39/045* (2013.01); *D06F 2204/088* (2013.01)

(58) Field of Classification Search
CPC . D06F 39/045; D06F 39/088; D06F 2204/088
USPC ..... 8/147, 158, 159; 68/12.03, 12.21, 12.22
See application file for complete search history.

(56) References Cited

U.S. PATENT DOCUMENTS

| | | | |
|---|---|---|---|
| 4,303,406 | A | 12/1981 | Ross |
| 5,161,393 | A | 11/1992 | Payne et al. |
| 5,669,095 | A | 9/1997 | Dausch et al. |
| 6,327,730 | B1 | 12/2001 | Corbett |
| 6,415,469 | B1 | 7/2002 | Diaz Fernandez et al. |
| 6,446,291 | B1 | 9/2002 | Diaz Fernandez et al. |
| 7,370,495 | B2 | 5/2008 | Johnson |
| 8,468,857 | B2 | 6/2013 | Nieh et al. |
| 8,505,139 | B2 | 8/2013 | Vanhazebrouck et al. |
| 2011/0247148 | A1 | 10/2011 | Chanda et al. |

FOREIGN PATENT DOCUMENTS

| | | |
|---|---|---|
| CN | 101082165 B | 3/2011 |
| JP | 10-015281 A | 1/1998 |

*Primary Examiner* — Levon J Shahinian
(74) *Attorney, Agent, or Firm* — Dority & Manning, P.A.

(57) ABSTRACT

Washing machine appliances and methods for operating washing machine appliances are provided. A method includes calculating a hot water fill time and a cold water fill time based on an assumed hot water temperature, an assumed cold water temperature, an assumed hot water flow rate, an assumed cold water flow rate, and a desired wash water temperature. The method further includes actuating a hot water valve to flow hot water for the hot water fill time, and actuating a cold water valve to flow cold water for the cold water fill time.

14 Claims, 3 Drawing Sheets

WASHING MACHINE APPLIANCES AND METHODS FOR OPERATING THE SAME

FIELD OF THE INVENTION

The present disclosure relates generally to washing machine appliances, and more particularly to methods and apparatus for operating washing machine appliances which provide improved wash water temperature control.

BACKGROUND OF THE INVENTION

Washing machine appliances generally include a tub for containing wash fluid, e.g., water and detergent, bleach and/or other wash additives. A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

One issue with washing machine appliance performance has been the accurate determination and control of water temperatures. Accurate control is critical for user perception of appliance quality, optimal appliance performance, and improved energy consumption. In many known washing machine appliances, temperature sensors are utilized to determine and control the water temperature in the tub. Flow regulators have additionally been utilized in combination with the temperature sensors. However, such components are costly, increasing the cost of the washing machine appliance. Such increased cost may be prohibitive to some potential users.

Accordingly, improved washing machine appliances and methods for operating washing machine appliances are desired in the art. In particular, washing machine appliances and methods having improved wash water temperature control capabilities, and which do not require temperature sensors, would be advantageous.

BRIEF DESCRIPTION OF THE INVENTION

In accordance with one embodiment of the present disclosure, a method for operating a washing machine appliance is provided. The method includes calculating a hot water fill time and a cold water fill time based on an assumed hot water temperature, an assumed cold water temperature, an assumed hot water flow rate, an assumed cold water flow rate, and a desired wash water temperature. The method further includes actuating a hot water valve to flow hot water for the hot water fill time, and actuating a cold water valve to flow cold water for the cold water fill time.

In accordance with another embodiment of the present disclosure, a washing machine appliance is provided. The washing machine appliance includes a tub, and a basket rotatably mounted within the tub, the basket defining a wash chamber for receipt of articles for washing. The washing machine appliance further includes a hot water valve in fluid communication with a hot water source, a cold water valve in fluid communication with a cold water source, and a nozzle configured for flowing water from the hot water valve and the cold water valve into the tub. The washing machine appliance further includes a motor in mechanical communication with the basket, the motor configured for selectively rotating the basket within the tub, and a controller in operative communication with the hot water valve and the cold water valve. The controller is operable for calculating a hot water fill time and a cold water fill time based on an assumed hot water temperature, an assumed cold water temperature, an assumed hot water flow rate, an assumed cold water flow rate, and a desired wash water temperature. The controller is further operable for actuating a hot water valve to flow hot water for the hot water fill time, and actuating a cold water valve to flow cold water for the cold water fill time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
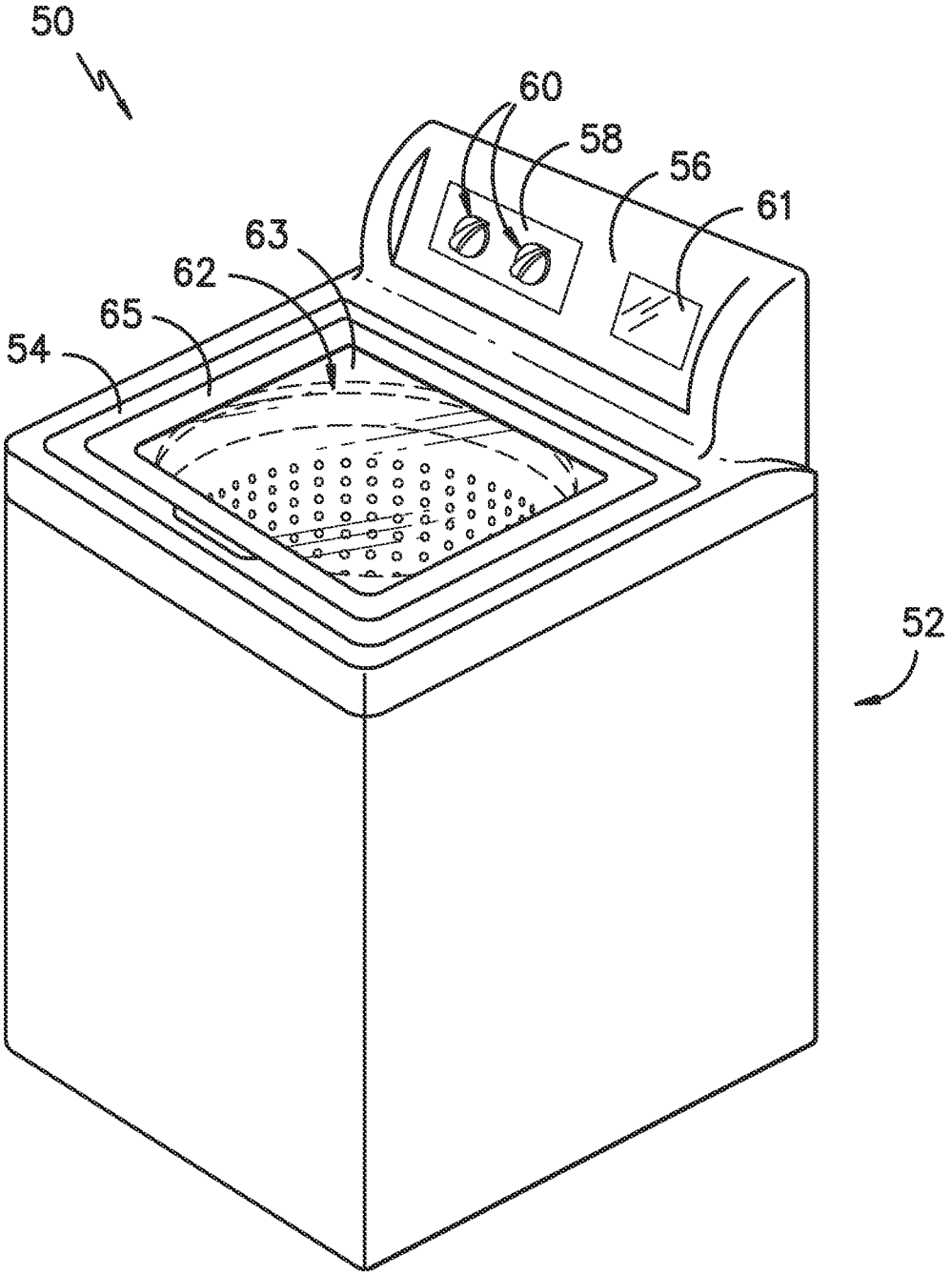
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIGS. 2 and 3) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
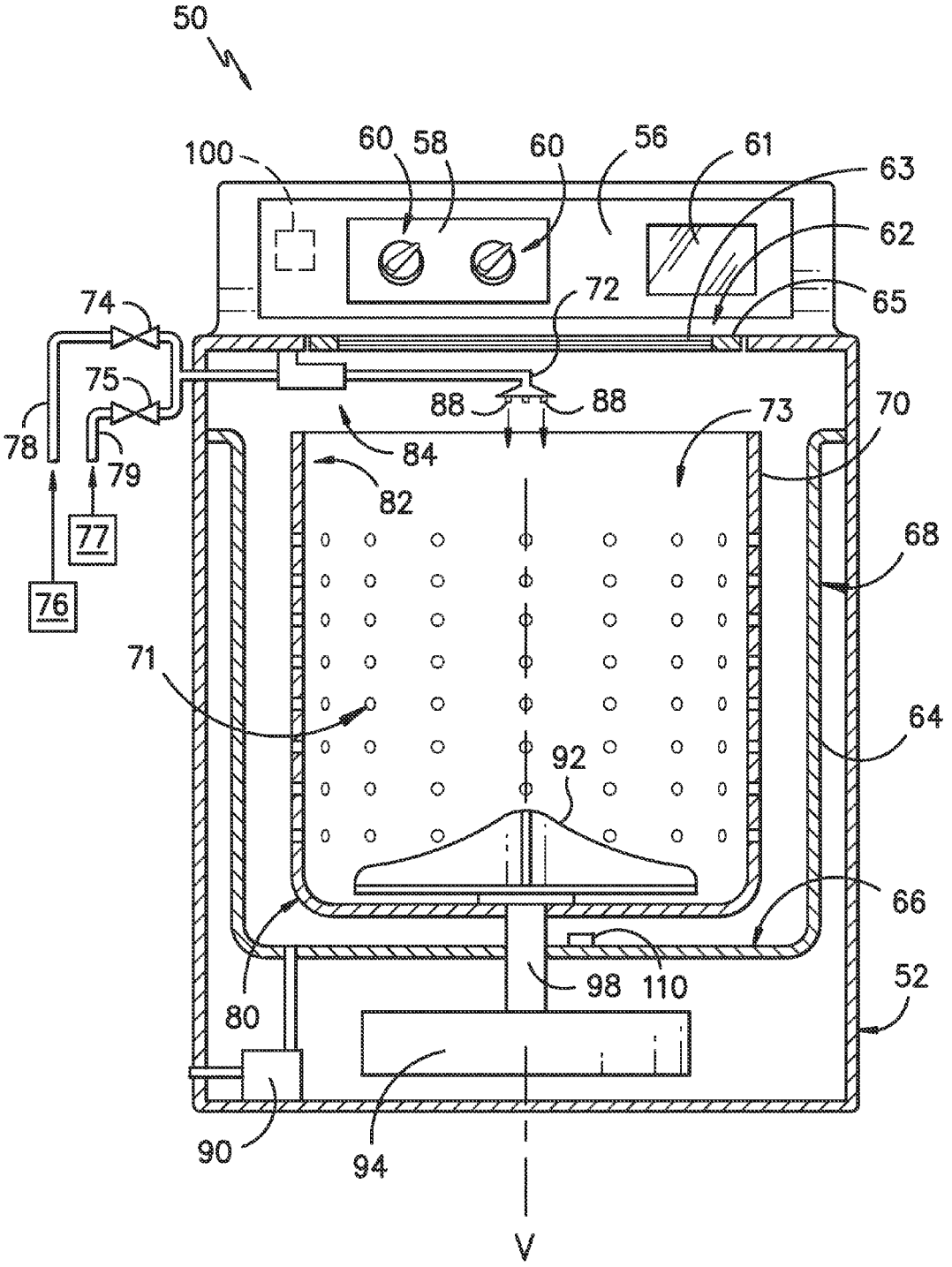
FIG. 2 provides a front, section view of a washing machine appliance in accordance with one embodiment of the present disclosure.

FIG. 2 provides a front, cross-section views of washing machine appliance 50. As may be seen in FIG. 2, tub 64 includes a bottom wall 66 and a sidewall 68. A wash drum or wash basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a hot water valve 74 and a cold water valve 75 may be utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIG. 2) is located beneath tub 64 and basket 70 for gravity assisted flow to drain tub 64.

An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94, such as a pancake motor. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated. Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or level of water in the tub 64. Additionally, a suitable speed sensor can be connected to the motor 94, such as to the output shaft 98 thereof, to measure speed and indicate operation of the motor 94. Other suitable sensors, such as temperature sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as valves 74, 75, motor 94, pressure sensor 110, and other suitable sensors, etc. In response to user manipulation of the input selectors 60, controller 100 may operate the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with water and mixed with detergent to form a liquid or wash fluid. Valves 74, 75 can be opened to initiate a flow of water into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained. Laundry articles can then be rinsed by again adding fluid to tub 64, depending on the particulars of the cleaning cycle selected by a user, agitation element 92 or basket 70 may again provide agitation within basket 70. One or more spin cycles may also be used. In particular, a spin cycle may be applied after the wash cycle and/or after the rinse cycle in order to wring wash fluid from the articles being washed. During a spin cycle, basket 70 is rotated at relatively high speeds.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
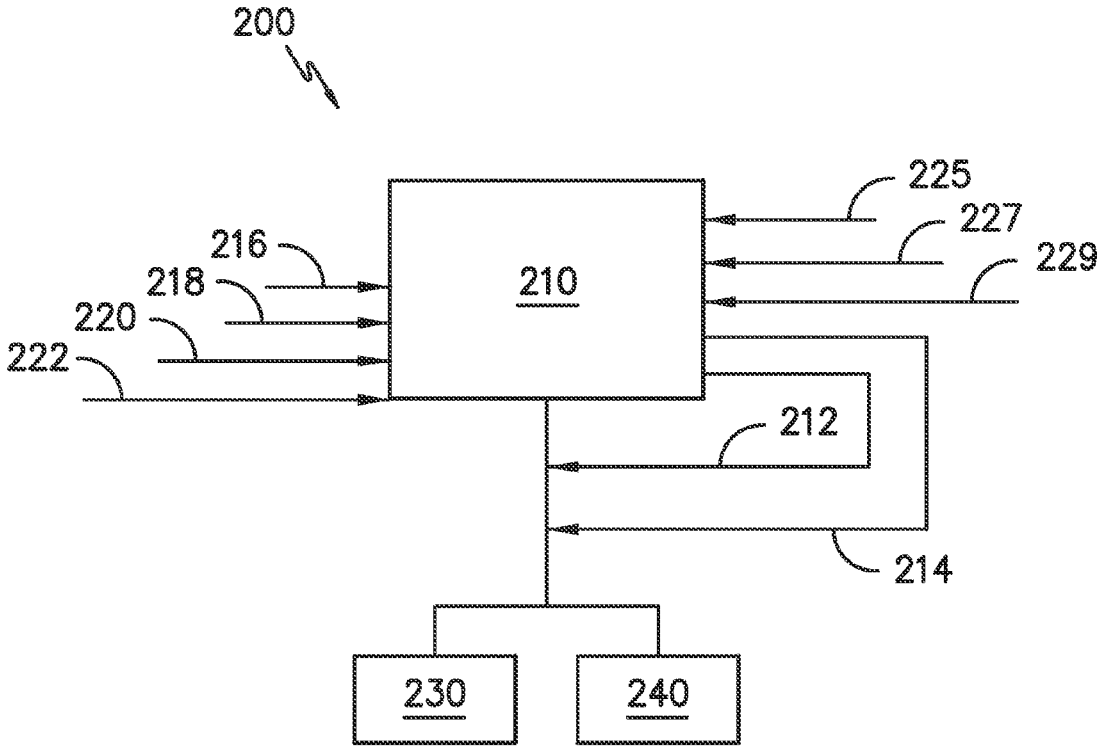
FIG. 3 provides a flow chart of an exemplary method for operating a washing machine appliance according to an exemplary embodiment of the present subject matter.

Referring now to FIG. 3, various methods may be provided for use with washing machine appliances 50 in accordance with the present disclosure. In general, the various steps of methods as disclosed herein may in exemplary embodiments be performed by the controller 100, which may receive inputs and transmit outputs from various other components of the appliance 50.

For example, as illustrated in FIG. 3 and indicated by reference number 200, methods for operating a washing machine appliance 50 are provided. Such methods generally and advantageously facilitate improved wash water temperature control. In particular, such methods utilize various assumptions with respect to water temperatures and flow rates to determine desired hot water and cold water flow times to reach a desired wash water temperature (the temperature of the volume of water in the tub 64 utilized during operation of the washing machine appliance 50 in, for example, a wash cycle).

Method 200 may include, for example, the step 210 of calculating a hot water fill time 212 and a cold water fill time 214. Such calculation may be based on various variables, some of which may include assumed values. For example, such calculation may be based on an assumed hot water temperature 216 and an assumed cold water temperature 218. These assumed values may be based on assumptions for the temperature of the water flowed through valves 74, 75 from the hot water source 76 and the cold water source 77. For example, the assumed hot water temperature 216 may be between approximately 110 degrees Fahrenheit and approximately 160 degrees Fahrenheit, such as between approximately 130 degrees Fahrenheit and approximately 140 degrees Fahrenheit. The assumed cold water temperature 218 may be between approximately 45 degrees Fahrenheit and approximately 80 degrees Fahrenheit, such as between approximately 55 degrees Fahrenheit and approximately 65 degrees Fahrenheit. Such assumed temperatures may, for example, be programmed into and saved in the controller 50 for use in the present method 200. The assumed temperatures may be programmed into and saved in the controller 50 during initial assembly of the appliance 50, or by a user who has received the appliance 50, or at any other stage of the life of the appliance 50.

The calculation 210 may additionally be based on an assumed hot water flow rate 220 and an assumed cold water flow rate 222. These assumed values may be based on assumptions for the flow rate of the water flowed through valves 74, 75 from the hot water source 76 and the cold water source 77. For example, the assumed hot water flow rate 220 may be between approximately 1.5 gallons per minute and approximately 3.0 gallons per minute, such as between approximately 1.6 gallons per minute and approximately 2.8 gallons per minute. The assumed cold water flow rate 222 may be between approximately 2.5 gallons per minute and approximately 4.0 gallons per minute, such as between approximately 2.8 gallons per minute and approximately 3.6 gallons per minute. Such assumed flow rates may, for example, be programmed into and saved in the controller 50 for use in the present method 200. The assumed flow rates may be programmed into and saved in the controller 50 during initial assembly of the appliance 50, or by a user who has received the appliance 50, or at any other stage of the life of the appliance 50.

As discussed herein, in some embodiments, the assumed hot water flow rate 220 and assumed cold water flow rate 222 may be different values. In other embodiments, the assumed hot water flow rate 220 and assumed cold water flow rate 222 may be equal. In some embodiments wherein the assumed flow rates are equal, an equation may be utilized for the calculating step 210 that does not require the assumed hot water flow rate 220 and assumed cold water flow rate 222 to be input into the equation, due to these flow rates being equal. In other embodiments, input of the assumed hot water flow rate 220 and assumed cold water flow rate 222 into one or more equations is required for the calculating step 210.

The calculation 210 may further be based on a desired wash water temperature 225. The desired wash water temperature 225 is a temperature at which a user desires the water in the tub 64 to be after filling of the tub 64, with water from the hot water source 76 and cold water source 77, is completed. A user may manually input a desired wash water temperature 225 before the calculating step 210 is performed, or may select a desired wash cycle (hot wash, warm wash, cold wash, etc.), wash option (article type, load size, etc.), etc. The wash cycle, wash option and/or combination thereof may be associated with a particular temperature, and when selected this temperature may be input as the desired wash water temperature 225.

In some embodiments, the calculation 210 may further be based on a desired wash water volume 227. The desired wash water volume 227 is a volume at which a user desires the water in the tub 64 to be after filling of the tub 64, with water from the hot water source 76 and cold water source 77, is completed. A user may manually input a desired wash water volume 227 before the calculating step 210 is performed, or may select a desired wash cycle (hot wash, warm wash, cold wash, etc.), wash option (article type, load size, etc.), etc. The wash cycle, wash option and/or combination thereof may be associated with a particular volume, and when selected this temperature may be input as the desired wash water volume 227.

Notably, the actual volume may be determined using any suitable methods or apparatus. In some embodiments, the assumed flow rates 220, 222 and/or other suitable variables, such as flow time, etc., may be utilized to determine an actual volume.

Further, in some embodiments, the calculation 210 is based on a temperature offset factor 229. The temperature offset factor 229 may generally compensate for one or more temperature varying factors in the washing machine appliance 50. For example, the material and surface area of the basket 70, tub 64, agitation element 92, and/or other components that may contact water when in the tub 64 may influence the temperature offset factor 229. The mass and material of the articles in the tub 64 to be washed may influence the temperature offset factor 229. The time that the water is in the tub 64, such as before the next step of a wash cycle begins or is completed, may influence the temperature offset factor 229. In exemplary embodiments, the temperature offset factor 229 is a multiplier utilized to modify one or more input values during the calculating step 210. For example, the temperature offset factor 229 may in some embodiments be applied to the desired wash water temperature 225. Additionally or alternatively, the temperature offset factor 229 may be applied to the assumed hot water temperature 216, the assumed cold water temperature 218, the assumed hot water flow rate 220, the assumed cold water flow rate 222, the desired wash water volume 227, and/or any other suitable input value.

Accordingly, hot water fill time 212 and cold water fill time 214 may be calculated based on various input variables as discussed. In some embodiments, the hot water fill time 212 and cold water fill time 214 may be individually calculated. For example, the hot water fill time 212 and cold water fill time 214 may be calculated in separate equations. In one embodiment, the calculating step 210 comprises executing the following equations:

$$t,h=[V,\text{bath}*(T,c-T,\text{bath})]/[Q,h*(T,c-T,h)]$$

and $$t,c=[V,\text{bath}*(T,\text{bath}-T,h)]/[Q,c*(T,c-T,h)]$$

wherein t,h is the hot water fill time; t,c is the cold water fill time; T,h is the assumed hot water temperature; T,c is the assumed cold water temperature; Q,h is the assumed hot water flow rate; Q,c is the assumed cold water flow rate; T,bath is the desired wash water temperature; and V,bath is the desired wash water volume. Accordingly, the hot water fill time 212 and cold water fill time 214 are separately and independently calculated.

In other embodiments, the hot water fill time 212 and cold water fill time 214 may be calculated together, such as in a single equation. For example, the hot water fill time 212 and cold water fill time 214 may be calculated as a ratio. In one embodiment, the calculating step 210 comprises executing the following equation:

$$t,h/t,c=[T,c-T,\text{bath}]/[T,\text{bath}-T,h)]$$

wherein t,h is the hot water fill time; t,c is the cold water fill time; T,h is the assumed hot water temperature; T,c is the assumed cold water temperature; and T,bath is the desired wash water temperature. Accordingly, the hot water fill time 212 and cold water fill time 214 are calculated together as a ratio.

Once the calculating step 210 has been performed, water may be flowed into the tub 64. The resulting volume of water in the tub 64 may advantageously have a temperature that is approximately equal to the desired wash water temperature 225. Further, the volume may be approximately equal to the desired wash water volume 227. Method 200 may thus include, for example, the step 230 of actuating the hot water valve 74 to flow hot water for the hot water fill time 212. Method 200 may further include, for example, the step 240 of actuating the cold water valve 75 to flow cold water for the cold water fill time 214.

In some embodiments, the valves 74, 75 may be actuated such that the hot water and cold water may be flowed concurrently. In these embodiments, the hot and cold water may be allowed to combine, such as upstream of the nozzle 72, and be flowed to the tub 64 together. For example, the valves 74 and 75 may be actuated simultaneously and then de-actuated at the respective hot water fill time 212 and cold water fill time 214. Alternatively, the valves 74 and 75 may be actuated at different times such that the hot water fill time 212 and cold water fill time 214 expire, and the valves 74 and 75 are de-actuated, simultaneously. In still other alternative embodiments, the valves 74 and 75 may be actuated and de-actuated at different times based on the hot water fill time 212 and cold water fill time 214, but may for some period during these times 212, 214 both be actuated such that both hot and cold water are flowed to the tub 64. In some of these embodiments, in particular in embodiments wherein the hot water fill time 212 and cold water fill time 214 are calculated together as a ratio, the valves 74, 75 may be actuated such that the hot water and cold water are flowed concurrently based on this fill time ratio (which may equal the hot water fill time 212 divided by the cold water fill time 214 or vice versa). This concurrent flow may occur until the actual volume reaches the desired wash water volume 227.

In other embodiments, the valves 74, 75 may be actuated such that the hot water and cold water may be flowed alternately. In these embodiments, the hot water and cold water may separately and individually be allowed to flow through the nozzle 72 and into the tub 64. For example, in some embodiments, one valve 74, 75 may be actuated for the entire fill time 212, 214, and then after completion of this fill time 212, 214 the other valve 74, 75 may be actuated for that entire fill time 212, 214. Alternatively, one or both valves 74, 75 may be actuated for a portion of the fill time 212, 214, and actuation may be alternated until both fill times 212, 214 have been reached. In some of these embodiments, in particular in embodiments wherein the hot water fill time 212 and cold water fill time 214 are calculated together as a ratio, the valves 74, 75 may be actuated such that the hot water and cold water are flowed alternately based on this fill time ratio (which may equal the hot water fill time 212 divided by the cold water fill time 214 or vice versa). This alternating flow may occur for various time periods until the actual volume reaches the desired wash water volume 227.

It should be noted that while in some embodiments the fill times are based on a desired wash water volume 227, filling need not cease based on this desired wash water volume. For example, the desired wash water volume 227 may be a minimum value, and a desired wash water level (or height) may additionally be utilized in accordance with the present disclosure. Such level may be determined by, for example, pressure sensor 110. After filling to the desired wash water volume 227, filling may, if required, continue until a desired wash water level is reached.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance comprising: a tub; a basket rotatably mounted within the tub, the basket defining a wash chamber for receipt of articles for washing; a hot water valve in fluid communication with a hot water source; a cold water valve in fluid communication with a cold water source; a nozzle configured for flowing water from the hot water valve and the cold water valve into the tub; a motor in mechanical communication with the basket, the motor configured for selectively rotating the basket within the tub; and a controller in operative communication with the hot water valve and the cold water valve, the method comprising:

calculating a hot water fill time and a cold water fill time based on an assumed hot water temperature, an assumed cold water temperature, an assumed hot water flow rate, an assumed cold water flow rate, and a desired wash water temperature;

actuating the hot water valve to flow hot water for the hot water fill time; and actuating the cold water valve to flow cold water for the cold water fill time, wherein the calculating step is further based on a desired wash water volume, and wherein the calculating step comprises executing the following equations:

$$t,h=[V,\text{bath}*(T,c-T,\text{bath})]/[Q,h*(T,c-T,h)]$$

and $$t,c=[V,\text{bath}*(T,\text{bath}-T,h)]/[Q,c*(T,c-T,h)]$$

wherein t,h is the hot water fill time; t,c is the cold water fill time; T,h is the assumed hot water temperature; T,c is the assumed cold water temperature; Q,h is the assumed hot water flow rate; Q,c is the assumed cold water flow rate; T,bath is the desired wash water temperature; and V,bath is the desired wash water volume.

2. The method of claim 1, wherein the assumed hot water flow rate and the assumed cold water flow rate are equal.

3. The method of claim 1, wherein the calculating step is further based on a temperature offset factor.

4. The method of claim 3, wherein the temperature offset factor is applied to the desired wash water temperature.

5. The method of claim 1, wherein the hot water and the cold water are flowed concurrently.

6. The method of claim 5, wherein the hot water and the cold water are flowed concurrently based on a fill time ratio, the fill time ratio equaling the hot water fill time divided by the cold water fill time.

7. The method of claim 1, wherein the hot water and the cold water are flowed alternately.

8. The method of claim 7, wherein the hot water and the cold water are flowed alternately based on a fill time ratio, the fill time ratio equaling the hot water fill time divided by the cold water fill time.

9. A washing machine appliance, comprising:

a tub;

a basket rotatably mounted within the tub, the basket defining a wash chamber for receipt of articles for washing;

a hot water valve in fluid communication with a hot water source;

a cold water valve in fluid communication with a cold water source;

a nozzle configured for flowing water from the hot water valve and the cold water valve into the tub;

a motor in mechanical communication with the basket, the motor configured for selectively rotating the basket within the tub; and a controller in operative communication with the hot water valve and the cold water valve, the controller configured for:

calculating a hot water fill time and a cold water fill time based on an assumed hot water temperature, an assumed cold water temperature, an assumed hot water flow rate, an assumed cold water flow rate, and a desired wash water temperature;

actuating the hot water valve to flow hot water for the hot water fill time; and actuating the cold water valve to flow cold water for the cold water fill time, wherein the calculating step is further based on a desired wash water volume, and wherein the calculating step comprises executing the following equations:

$$t,h=[V,\text{bath}*(T,c-T,\text{bath})]/[Q,h*(T,c-T,h)]$$

and $$t,c=[V,\text{bath}*(T,\text{bath}-T,h)]/[Q,c*(T,c-T,h)]$$

wherein t,h is the hot water fill time; t,c is the cold water fill time; T,h is the assumed hot water temperature; T,c is the assumed cold water temperature; Q,h is the assumed hot water flow rate; Q,c is the assumed cold water flow rate; T,bath is the desired wash water temperature; and V,bath is the desired wash water volume.

10. The washing machine appliance of claim 9, wherein the assumed hot water flow rate and the assumed cold water flow rate are equal.

11. The washing machine appliance of claim 9, wherein the calculating step is further based on a temperature offset factor.

12. The washing machine appliance of claim 11, wherein the temperature offset factor is applied to the desired wash water temperature.

13. The washing machine appliance of claim 9, wherein the hot water and the cold water are flowed concurrently.

14. The washing machine appliance of claim 9, wherein the hot water and the cold water are flowed alternately.

* * * * *